United States Patent [19]

Christman et al.

[11] 4,016,070

[45] Apr. 5, 1977

[54] MULTIPLE STAGE HYDRODESULFURIZATION PROCESS WITH EXTENDED DOWNSTREAM CATALYST LIFE

[75] Inventors: Robert D. Christman; Jordan S. Lasher; John A. Paraskos, all of Pittsburgh; Stephen J. Yanik, Valencia, all of Pa.

[73] Assignee: Gulf Research & Development Company, Pittsburgh, Pa.

[22] Filed: Nov. 17, 1975

[21] Appl. No.: 632,376

[52] U.S. Cl. ..... 208/210

[51] Int. Cl.[2] ..... C10G 23/02

[58] Field of Search ..... 208/210, 216

[56] References Cited

UNITED STATES PATENTS

| | | | |
|---|---|---|---|
| 2,878,179 | 3/1959 | Henning | 208/210 |
| 3,418,234 | 12/1968 | Chervenak et al. | 208/210 |
| 3,519,557 | 7/1970 | Pruiss | 208/210 |
| 3,607,000 | 9/1971 | Beal et al. | 208/216 |
| 3,795,607 | 3/1974 | Adams et al. | 208/210 |
| 3,850,744 | 11/1974 | Plundo et al. | 208/210 |

*Primary Examiner*—George Crasanakis

[57] ABSTRACT

A multiple stage process for hydrodesulfurizing a residual oil while passing the oil downwardly through a plurality of stages in series with an interstage flashing step. After the catalyst in the downstream stage is deactivated by coke deposition, fresh feed oil is passed directly to the deactivated catalyst to obtain an extended life in the downstream catalyst.

3 Claims, 4 Drawing Figures

Figure 1:
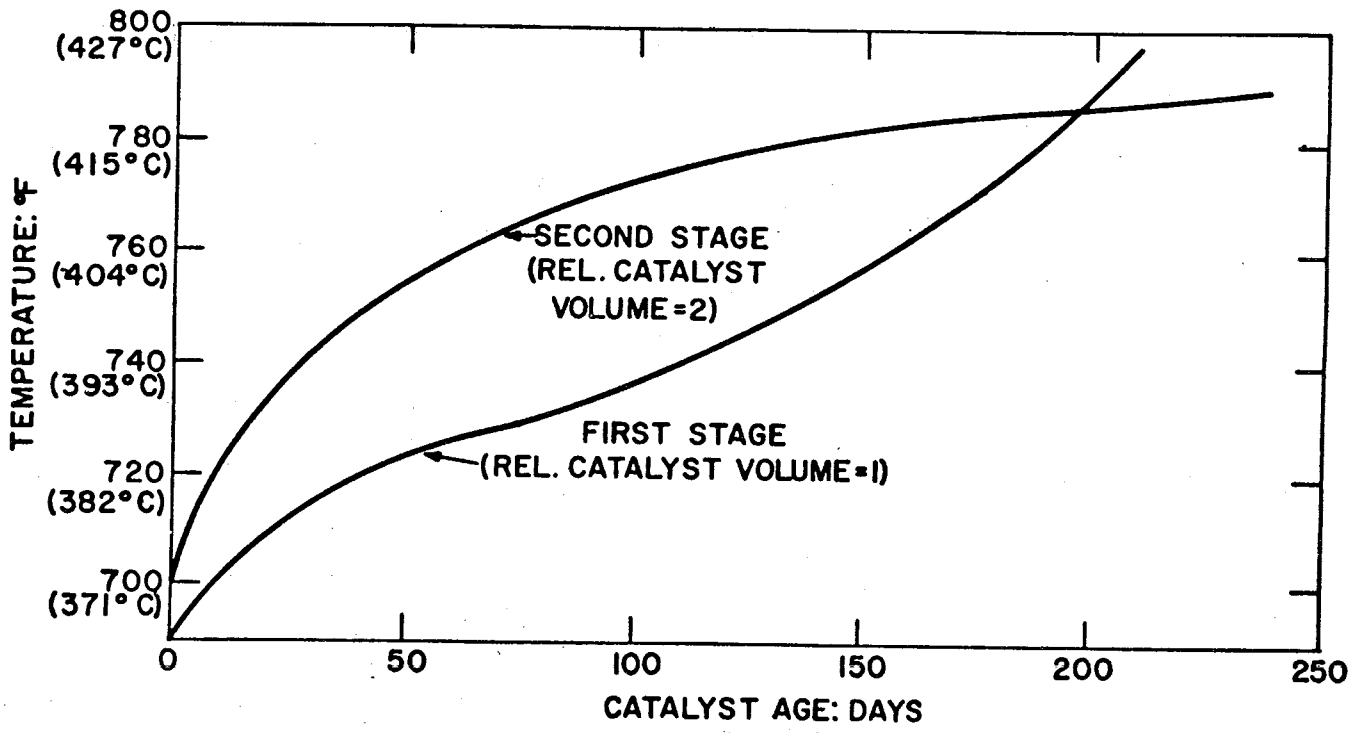

FEED TO THIRD STAGE
DESULFURIZED RESIDUAL OIL
CONTAINING 0.3% S.
FEED TO THIRD STAGE
NON-DESULFURIZED
RESIDUAL OIL
CONTAINING 4% S.
1.0 REL. LHSV
0.5 REL. LHSV
0.35 REL. LHSV
DMS ADDITION
H2S CIRCULATION
TOTAL LIQUID PRODUCT
SULFUR CONTENT: Wt. %
1.1
1.0
.9
.8
.7
.6
.5
.4
.3
.2
.1
0
REACTOR TEMPERATURE: °F
780 (416°C)
770 (410°C)
760 (404°C)
750 (399°C)
1 2 3 4 5 6 7 8 9 10 11 12 13 14 15 16 17 18 19 20 21 22 23 24
CATALYST AGE (DAYS)

MULTIPLE STAGE HYDRODESULFURIZATION PROCESS WITH EXTENDED DOWNSTREAM CATALYST LIFE

This invention relates to a catalytic process for the hydrodesulfurization of metal- and sulfur-containing asphaltenic heavy oils.

More particularly, the present invention relates to a multi-reactor hydrodesulfurization process employing a flashing step between reactors wherein the downstream reactor catalyst tends to become deactivated before the upstream reactor catalyst and wherein the life of the downstream reactor catalyst is extended by passage of fresh feed oil directly into the downstream reactor.

The present process employs a supported Group VI-B and Group VIII metal hydrodesulfurization catalyst. One or more metals from other groups can also be present, such as titanium. Suitable Group VI-B and Group VIII metal combinations include cobalt-molybdenum, nickel-tungsten and nickel-molybdenum. A preferred combination is nickel-cobalt-molybdenum. The catalyst can comprise 5 to 30 weight percent, generally, and 8 to 20 weight percent, preferably, of Group VI-B and VIII metals. The remainder of the catalyst generally comprises a highly porous, non-cracking supporting material. Alumina is the preferred supporting material but other porous non-cracking supports can be employed, such as silica-alumina and silica-magnesia. Preferably, all or a large proportion of the catalyst particles have a diameter between about 0.025 and 0.05 inch (0.0635 to 0.127 cm), and can be in any suitable shape, such as extrudates, granules or spheres. Whatever the shape of a catalyst particle, the diameter is defined as the smallest surface-to-surface dimension extending through the center or axis of the particle.

In the present process, the feed oil flows downwardly through fixed beds of the catalyst to remove 60, 70, 80 or more weight percent of the feed metals and sulfur from the oil. Very little hydrocracking occurs in the process. Most of the product oil boils above the initial boiling point of the feed oil, generally, and preferably at least 70, 80 or 90 percent of the total product boils above the IBP of the feed oil to the first stage.

The hydrodesulfurization process employs a hydrogen partial pressure of 500 to 5,000 pounds per square inch gauge (35 to 350 kg/cm$^2$), generally, 1,000 to 3,000 pounds per square inch (70 to 210 kg/cm$^2$), preferably, and 1,500 to 2,500 pounds per square inch (105 to 175 kg/cm$^2$), most preferably.

The gas circulation rate can be between 1,000 and 20,000 standard cubic feet per barrel of oil (17.8 and 356 SCM/100L), generally, or preferably about 2,000 to 10,000 standard cubic feet per barrel of oil (35.6 to 178 SCM/100L). The gas circulated preferably contains 80 percent or more of hydrogen. The mol ratio of hydrogen to oil can be between about 4:1 and 80:1. Reactor temperatures can vary between about 600° and 900° F. (316° and 482° C.), generally, and between 650° and 800° F. (343° and 427° C.), preferably. Reactor temperatures are increased during a catalyst cycle to compensate for activity aging loss until a reactor constraint temperature is reached, at which time the catalyst is considered deactivated. The temperature should be sufficiently low so that not more than 30 percent, generally, and preferably not more than about 10, 15 or 20 percent of the 650° F.+ (343° C.+) feed oil will be cracked to material boiling below 650° F. (343° C.). The liquid hourly space velocity in each reactor can be between about 0.1 and 10, generally, and preferably, between about 0.2 and 1 or 1.25 volumes of oil per hour per volume of catalyst.

The fresh feed to the process of this invention can be a full petroleum crude or a reduced crude containing substantially all of the residual asphaltenes of the full crude. The process is also useful for desulfurizing and demetallizing other asphaltene-containing oils, such as coal liquids and oils extracted from shale and tar sands. Asphaltenes have a relatively low molecular hydrogen to carbon ratio and will generally comprise less than about 10 percent of the feed oil, but will generally contain most of the metallic components present in the total feed, such as nickel and vanadium.

Petroleum atmospheric or vacuum tower residua contain substantially the entire asphaltene fraction of the crude from which they are derived and therefrom contain 95 to 99 weight percent or more of the nickel and vandium content of the full crude. The nickel, vanadium and sulfur content of petroleum residua can vary over a wide range. For example, nickel and vanadium can comprise 0.002 to 0.03 weight percent (20 to 300 parts per million) or more of the residua, while sulfur can comprise about 2 to 7 weight percent, or more, of the oil.

The desulfurization catalysts have a high activity for demetallization as well as for desulfurization and the catalyst removes most of the nickel and vanadium from the feed oil stock as well as most of the sulfur. These metals deposit heavily on the outermost regions of the catalyst cross-section and tend to inhibit access to catalyst pores and thereby reduce the desulfurization activity of the catalyst. Upon blockage of the pores, the aging rate of the catalyst ceases to be gradual and increases abruptly to terminate the catalyst cycle. Therefore, removed nickel and vanadium generally account for the ultimate deactivation of first stage desulfurization catalysts, while coke deposition during removal of sulfur and nitrogen contributes relatively little to catalyst deactivation in the first stage.

In the context of the present invention, a first stage denotes one or more reactors which precede an interstage flashing step, while a second stage denotes a reactor which follows the interstage flashing step. The hydrogen pressure is sufficiently high that most of the metals and sulfur are removed from a feed oil in a first stage reactor. In fact, more than 80 percent of all metals removal can be completed before the feed oil reaches the bottom of a first stage reactor. The oil is then passed to the second stage reactor for removal of the more refractory sulfur. In the second stage, the primary cause of catalyst deactivation is coking. Desulfurization severity is inherently greater in the second stage than in the first stage, and it is known that catalyst coking increases with desulfurization severity. Catalyst coking occurs so extensively in a second hydrodesulfurization stage that the second stage aging rate is considerably more rapid than the first stage aging rate. In prior art catalytic two-stage residual oil hydrodesulfurization processes employing an interstage flash for removal of contaminant by-product gases, such as hydrogen sulfide, ammonia and gaseous hydrocarbons, and with progressively increasing temperatures in each stage to compensate for catalyst aging, it is commonly known that both the catalyst aging rate and coke formation on the catalyst is considerably greater in the second stage than in the first stage. Although the removal of hydrogen sulfide and ammonia is desirable since these materials are reaction products, the lack of any of these materials in a downstream stage is detrimental to catalyst activity and contributes to downstream catalyst coking. This effect is the subject of U.S. Pat. No. 3,860,511. This high second stage coking phenomenon can also probably be explained on a molecular basis. In the first stage, the existence of peripheral alkyl groups on feed asphaltene and resin molecules provides steric hindrance which tends to prevent contact of the polycondensed ring inner body of the residual molecules with the catalyst. However, the most refractory sulfur in the asphaltene molecules is not removed in the first stage and must be removed in a second stage. This sulfur is more refractory because it tends to be deeply imbedded within the aromatic nucleus. Following the elimination of some of the alkyl groups in the first stage, the molecules entering the second stage are sterically better adapted to permit the aromatic nucleus to abut broadly against catalyst sites exposing the hydrogen and carbon atoms and ultimately the imbedded sulfur more intimately to the catalyst surface, thereby inducing coking. This mechanism probably accounts for the enhanced catalyst coking and higher aging rates in the second stage, as compared to the first stage.

The present invention is illustrated in the attached figures wherein

Figure 2:
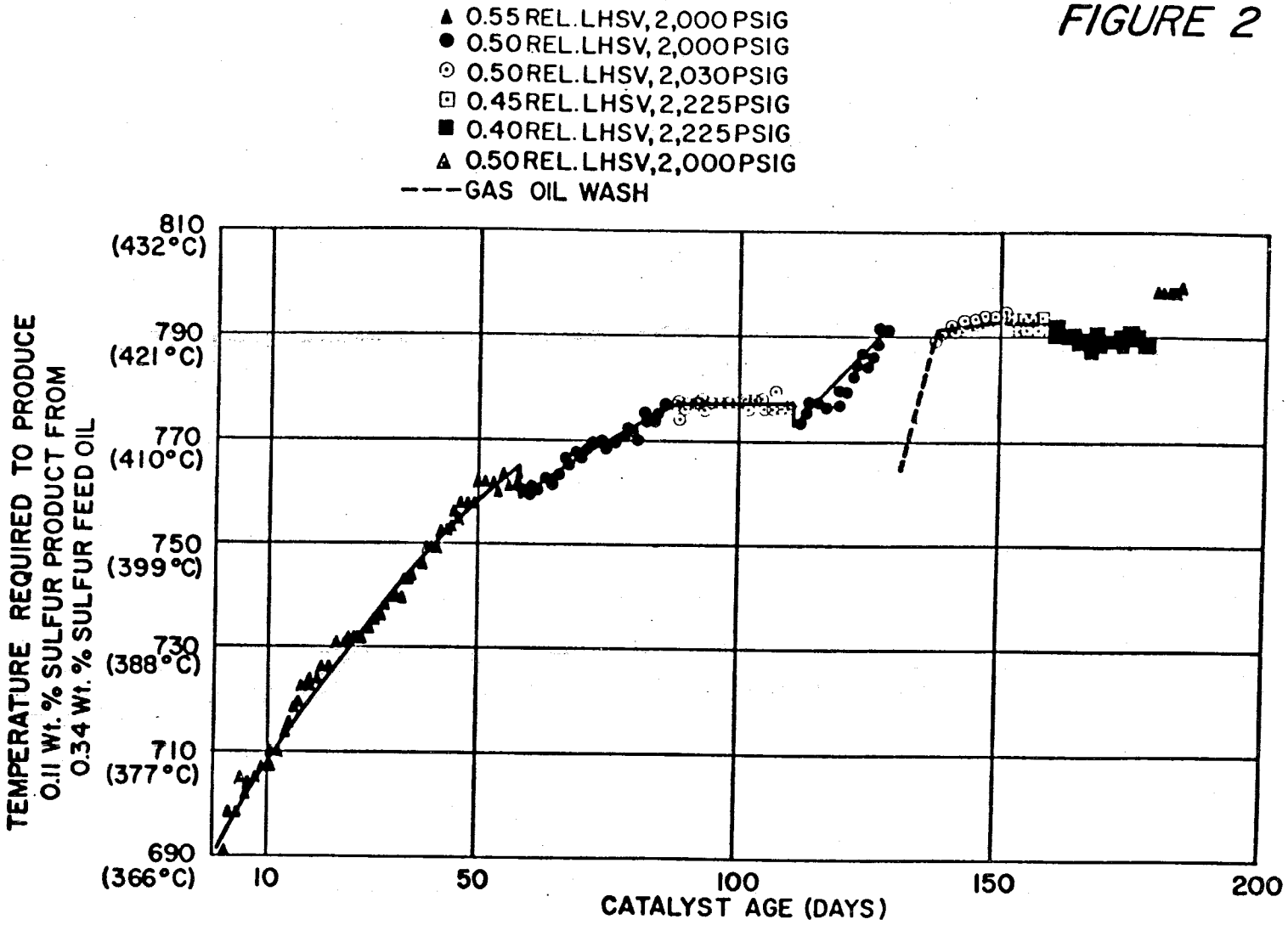
Figure 3:
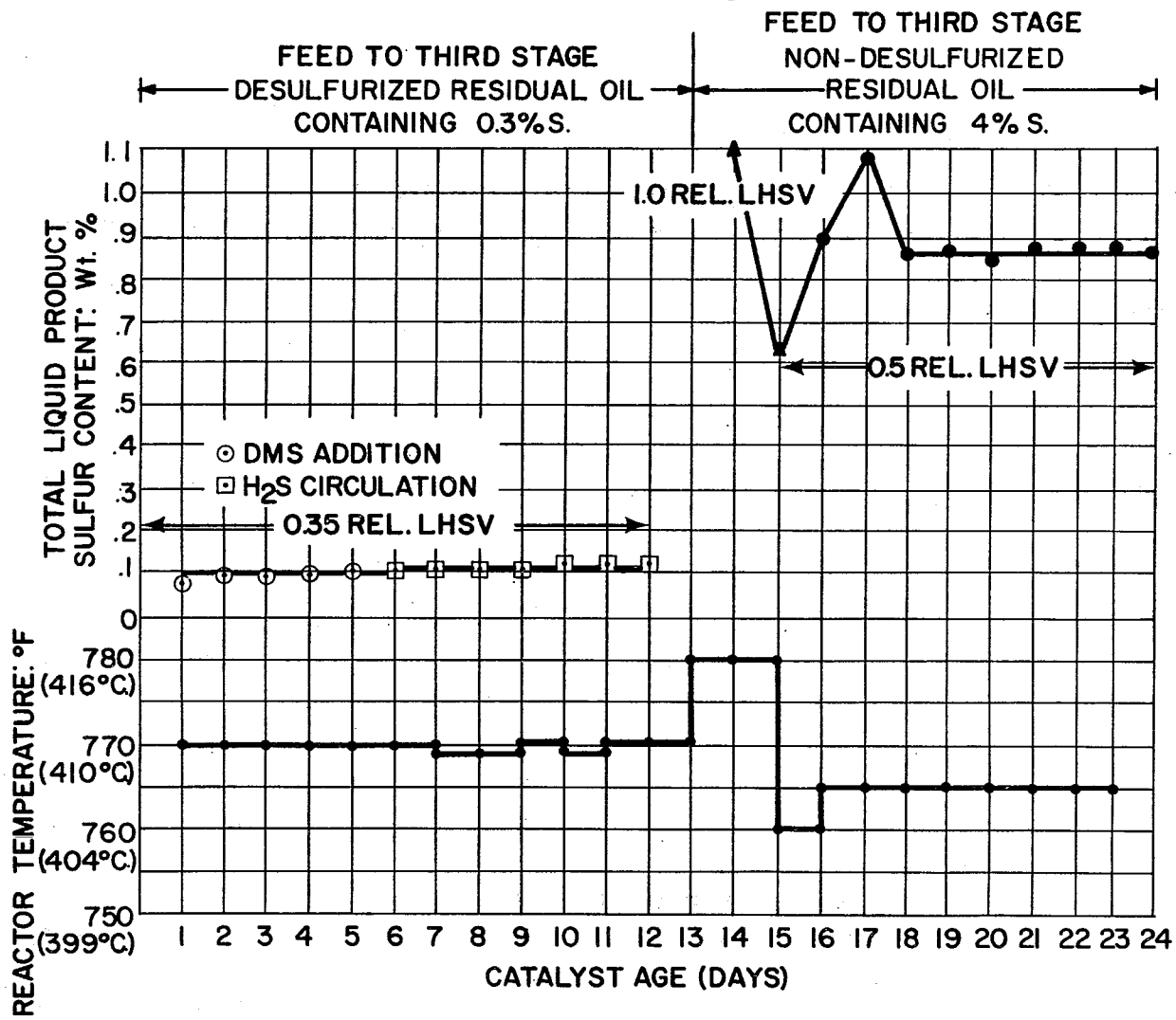

FIGS. 1, 2 and 3 present catalyst aging curves and

Figure 4:
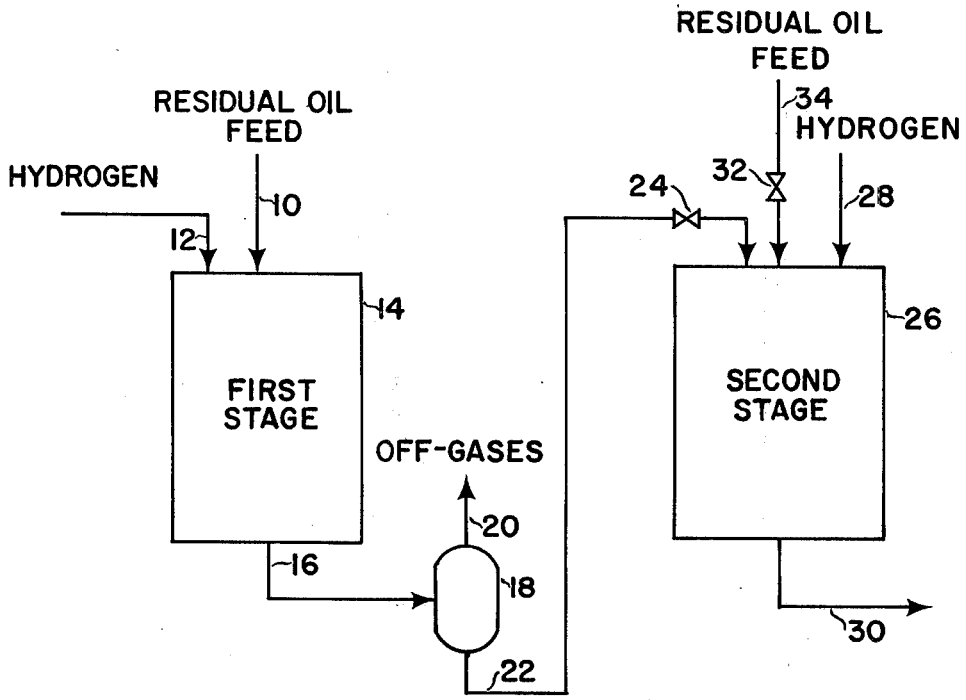

FIG. 4 presents a process flow scheme for performing the present invention.

FIG. 1 presents aging curves for first and second stages in series of a downflow petroleum residual oil hydrodesulfurization process with an interstage flashing step to remove contaminant gases wherein both reactors have a common metallurgy constraint temperature of about 790° F. (421° C.). Both reactors contain a fixed bed of stationary catalyst particles. The lower curve represents the first stage aging characteristics of a nickel-cobalt-molybdenum on alumina catalyst in desulfurizing a 650° F.+ (343° C.+) Kuwait residual oil from 4 to 1 weight percent sulfur at a relative LHSV of 1.0 over the full aging period until the constraint temperature of 790° F. (421° C.) is reached. After flashing of hydrogen-containing gaseous impurities, including hydrogen sulfide, ammonia, gaseous and some low boiling liquid hydrocarbons, and subsequent addition of fresh hydrogen, the flash residue of the first stage hydrodesulfurization step is hydrodesulfurized in a second stage to reduce its sulfur content from 1 to 0.3 weight percent. The upper curve of FIG. 1 represents the second stage aging curve over the full aging period until the 790° F. (421° C.) constraint temperature is reached. The weight of catalyst employed in the second stage was twice that employed in the first stage reflecting the greater difficulty of the second stage operation due to the lower concentration of sulfur and the more refractory nature of the sulfur being removed in the second stage, as well as reflecting the removal in the interstage flashing step of catalyst activating materials such as ammonia and hydrogen sulfide. Even though a total of about 3 weight percent sulfur was removed in the first stage while a total of only about 0.7 weight percent sulfur was removed in the second stage, and even though the second stage utilized twice as much catalyst as the first stage, FIG. 1 shows that throughout the catalyst aging cycle a considerably higher temperature was required in the second stage as compared to the first stage due to a much greater coke deposit on the second stage catalyst as compared to the first stage catalyst.

FIG. 2 presents a more detailed picture of a late stage petroleum residual oil hydrodesulfurization aging curve, specifically a third stage aging curve, using a nickel-cobalt-molybdenum on alumina catalyst. In the test illustrated in FIG. 2, although there was a flash step between the first and second stages, there was no flash step between the second and third stages. The stage represented in the data of FIG. 2 produced a product containing 0.11 weight percent sulfur from an effluent from a second stage containing 0.34 weight percent sulfur at 1850 psi (130 kg/cm$^2$) hydrogen pressure and 5,000 SCF/B (89 SCM/100L) of a stream containing 85 percent hydrogen. As shown in FIG. 2, due to rapid catalyst aging and rapid approach of the 790° F. (421° C.) reactor constraint temperature, process severity required incremental amelioration in order to keep the reactor in operation until earlier stages also reached the constraint temperature, as indicated by step-wise reductions in relative space velocity from 0.55 to 0.50, to 0.45, and to 0.40, while sulfur compounds were added in all but the first two space velocity intervals indicated in FIG. 2 to maintain the catalyst in a sulfided condition in the face of the low quantity of sulfur removed in the reactor. FIG. 2 shows that at the end of the aging period a relative space velocity of 0.50 was attempted, but at this space velocity at the last period in the catalyst cycle the constraint temperature had to be exceeded in order to achieve the desired product sulfur level. Such a situation ordinarily requires termination of the catalyst cycle.

FIG. 3 represents an extension of the aging curve of FIG. 2. In order to attempt an extension of the life of the third stage catalyst, the relative LHSV was lowered drastically to 0.35 and dimethyl sulfide or hydrogen sulfide was added, permitting production of a 0.1 weight percent sulfur product at only 770° F. (371° C.). However, this space velocity was totally inadequate for processing a volume of oil as would be required with the reactor in series with earlier reactor stages. Thereupon, fresh non-desulfurized petroleum residual oil stream containing 4 weight percent sulfur which had constituted the feed to the first desulfurization stage was charged directly to the third stage. Initially, the non-desulfurized stream was introduced at a liquid hourly space velocity of 1.0, and a product sulfur level of 1.1 was obtained at 780° F. (416° C.). Since this temperature is close to the 790° F. (421° C.) constraint temperature, the relative LHSV was lowered to 0.5 and a product containing 0.86 percent sulfur was obtained at a reactor temperature of only 760° F. (404° C.). In this manner, the third stage reactor, after it was completely deactivated for third stage purposes, was found to be capable of desulfurizing the full flow rate of oil that had been charged to the first stage to obtain a product sulfur level of less than the 1 percent sulfur level obtained from the first stage with the same feed. Furthermore, FIG. 2 shows that at a steady temperature of 765° F. (407° C.), which is well below the 790° F. (421° C.) metallurgical constraint temperature of the reactor, this surprising result is achieved with no catalyst aging during the period of the test, even though the catalyst had previously been completely coke deactivated for purposes of standard third stage operation.

A possible theory relating to the data of FIG. 3 is that passage of fresh feed residual oil over a coke-deactivated catalyst in a downstream reactor induces a reduction of the equilibrium coke level on the downstream deactivated catalyst, even though there is no intervention of an oxidation or other type of catalyst regeneration step.

FIG. 4 presents a process to take advantage of the catalyst life extension effect of fresh feed oil on a downstream catalyst. As shown in FIG. 4, feed residual oil is charged through line 10 while hydrogen is charged through line 12 to first stage catalytic hydrodesulfurization reactor 14. An effluent stream is removed from the first stage reactor through line 16 and passed to flash chamber 18. Off-gases including hydrogen, ammonia, hydrogen sulfide and light hydrocarbons are removed from flash chamber 18 through line 20 while residual oil is removed through line 22 and passed through open valve 24 to second stage catalytic reactor 26. Hydrogen is charged to second stage reactor 26 through line 28. Valve 32 in fresh residual oil feed line 34 is closed at this process stage. Second stage effluent is removed through line 30.

First stage catalytic reactor 14 and second stage catalytic reactor 26 each contains a fixed bed of stationary catalyst particles and each is operated by gradually increasing the reaction temperature to compensate for catalyst deactivation to the extent required to produce an effluent oil having a desired sulfur content. The catalyst in each stage is considered to be deactivated when the process temperature must be elevated to achieve the desired product sulfur level to a temperature which is considered the constraint temperature for the system, e.g. 790° F. (421° C.). Preferably, the constraint temperature in both stages is reached at about the same time. When the constraint temperature is reached in second stage reactor 26, valve 24 is closed disconnecting second stage 26 from first stage 14, and thereupon valve 32 is opened. Now, the catalyst in second stage 26 which had been entirely deactivated, as indicated by requiring operation at or near the constraint temperature when treating the desulfurized effluent from the first stage, is able to operate at a temperature considerably below the constraint temperature and/or is able to operate at a considerably higher space velocity when hydrodesulfurizing the fresh residual feed oil being charged through line 34.

This same effect can be achieved without employing any valves in the reactor apparatus by omitting valve 24 and installing residual oil feed line 34 without a valve when the apparatus is shut down. A shut down will be necessary when the first stage catalyst becomes deactivated. The piping change is made to direct fresh feed to the second stage. Thereupon, the second stage is operated to produce the desulfurization level that is ordinarily achieved in the first stage, while the first stage catalyst is being renewed. In this manner, the on-stream factor of the reactor system is increased over the total system life.

We claim:

1. A process for hydrodesulfurization of residual feed oil comprising passing said oil and hydrogen downwardly through both first and second fixed bed catalytic hydrodesulfurization zones in series at a temperature of 600° and 900° F. and a hydrogen pressure of 500 to 5,000 psi, the catalyst in said zones comprising supported Group VI-B and Group VIII metals, flashing contaminant gases including hydrogen sulfide and ammonia from the oil flowing between said first and second zones, increasing the temperature in said zones to compensate for catalyst activity loss with increasing catalyst age, teminating said flow of said feed oil to said first zone when said second stage catalyst becomes substantially deactivated, and then directly charging said feed oil downwardly through said second zone thereby extending the operable life of said substantially deactivated second stage catalyst.

2. The process of claim 1 wherein said first zone catalyst becomes deactivated due to metals deposits on the catalyst and said first zone catalyst is being renewed while said residual feed oil is being charged through said second zone.

3. The process of claim 1 wherein the charging of said feed oil directly to the second zone reduces the coke level on the catalyst in said second zone.

* * * * *